US006513437B2

(12) United States Patent
Chan et al.

(10) Patent No.: US 6,513,437 B2
(45) **Date of Patent: *Feb. 4, 2003**

(54) BLAST INITIATION DEVICE

(75) Inventors: Sek K. Chan, Pierrefonds (CA); Raymond Carriere, Brownsburg (CA); John T. Reid, Kanata (CA)

(73) Assignee: Orica Explosives Technology Pty Ltd., Melbourne (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/559,662

(22) Filed: Apr. 28, 2000

(65) Prior Publication Data

US 2002/0162473 A1 Nov. 7, 2002

(51) Int. Cl.[7] ..... C06O 5/04

(52) U.S. Cl. ..... 102/275.7; 102/275.5; 102/275.9

(58) Field of Search ..... 102/275.5, 275.7, 102/275.9, 275.1–275.11

(56) References Cited

U.S. PATENT DOCUMENTS

| | | | | |
|---|---|---|---|---|
| 3,205,818 A | | 9/1965 | Coulson | |
| 3,987,732 A | * | 10/1976 | Spraggs et al. | 102/275.7 |
| 4,290,366 A | | 9/1981 | Janoski | 102/202.3 |
| 4,696,231 A | | 9/1987 | Bryan | |
| 5,171,935 A | | 12/1992 | Michna et al. | |
| 5,182,417 A | | 1/1993 | Rontey et al. | 102/204 |
| 5,204,492 A | | 4/1993 | Jacob et al. | |
| 5,398,611 A | | 3/1995 | Michna et al. | |
| 5,499,581 A | | 3/1996 | Sutula, Jr. | |
| 5,703,319 A | | 12/1997 | Fritz et al. | |
| 5,792,975 A | | 8/1998 | Tseka et al. | |

FOREIGN PATENT DOCUMENTS

| | | |
|---|---|---|
| AU | A-72847/91 | 5/1992 |
| AU | 41326/96 | 5/1996 |
| AU | 199671650 | 5/1997 |
| EP | 0 43995 | 12/1990 |
| WO | WO 96/11375 | 4/1996 |
| WO | WO 99/46221 | 9/1999 |

* cited by examiner

*Primary Examiner*—Michael J. Carone
*Assistant Examiner*—Lulit Semunegus

(57) ABSTRACT

A detonator device and assembly for the initiating a plurality of signal transmission lines with a pressure impulse. The detonator device comprising a detonator casing having a signal receiving end and a firing end. The firing end of the detonator device being substantially shaped to conform with the pressure impulse initiation therein. The firing end having a contact wall of substantially uniform thickness for contacting a plurality of signal transmission lines in a compatible connector element and transmitting a pressure impulse thereto.

24 Claims, 5 Drawing Sheets

BLAST INITIATION DEVICE

BACKGROUND OF THE INVENTION

1. Field of Invention

The present invention relates to blast initiation devices. More specifically, the present invention relates to a detonator device having at least one signal transmission surface for communication of pressure impulse to neighbouring transmission lines or the like, in a detonator assembly or blasting system.

2. Description of Related Art

Concern about the versatility and precision of blasting systems has been the focus of the explosives industry for decades. Current blasting practices widely employ low brisance transmission lines as a non-electrical means of transmitting blasting signals to target detonators for initiating explosive columns in a precise and reliable manner.

Modern non-electric blasting systems typically comprise a series of shock tubes or signal transmission lines positioned in contact with a donor detonator within a connection block or the like. Transmission lines, or shock tubes as they are more commonly known, generally consist of a hollow tube housing a gas, and having an inner lining comprising a reactive material. The reactive material typically comprises aluminum powder and HMX explosive powder. These shock tubes are used to conduct an initiation impulse to the target detonators at remote locations within a blasting arrangement. Upon initiation, the pressure of an incoming impulse causes the wall of the shock tube to collapse, pressurizing and subsequently heating the gas within the tube and igniting the reactive lining.

A first detonator is generally initiated via an initiation shock tube to begin a chain of initiation steps within a blasting system. The pressure impulse generated by this first detonator is subsequently transmitted by neighbouring shock tubes to remote target detonators throughout the blasting system. Since the success of the ultimate blast or blasts is dependent on the reliability and timing of a pressure impulse arriving at the desired blast location(s), it is critical that all of the components of the blasting system are correctly and completely initiated. Upon initiation, the strength of the propagating pressure impulse is constant and independent of the mode of initiation and signal transmission line length. The propagation of such an impulse is therefore limited by the obstacles it encounters along a transmission pathway.

The prior art has largely focused on improving the precision and control of detonator initiation. In particular, the prior art teaches an extensive variety of detonator devices including timing control components for providing constant and stable ignition stimuli. The prior art also includes an abundance of connector components for use in blasting systems for precisely controlling the positioning of shock tubes with respect to detonators in blasting systems. These efforts have come a long way in improving the safety and reliability of detonator assemblies. However, given the nature of explosive compositions and devices, there is always room for improvement to the safety of the blasting systems employed worldwide.

European Patent No. 0 439 955 discloses a delay detonator having a transition element for providing a stable ignition signal to the delay train element of the detonator. According to this invention, a transition element separates the delay train element from the ignition source. This transition element comprises a material which, when ignited by an ignition signal, develops a substantially constant intensity for igniting the delay train element. As a result, this transition element stabilizes an ignition signal prior to igniting the delay train element of the detonator. More specifically, the delay time interval is dependent upon the intensity of the signal by which it is ignited. Accordingly, by providing a transition element of a suitable reactable material, the typical variable burn rate of an ignition signal can be transformed into a stable, quasi-steady state combustion rate for the controlled ignition of the delay train element. The time internal of the delay train element is therefore more precisely performed.

The detonator of this invention comprises of a typical tubular casing having a receiving end and a firing end. The exterior surface of the firing end of this detonator is shown to have a rounded shape As with most conventional detonator casings, the firing end of this detonator may be flat, rounded or otherwise shaped for convenience within a blasting system. An explosive composition is positioned within the tubular casing at a location most proximate to the firing end. The remaining components of the detonator are sequentially received through the receiving end according to their required role in the ultimate ignition of the explosive composition. The delay train element ignites the explosive composition contained at the firing end of the detonator. As a result, the delay train element must be positioned within the tubular casing of the detonator to contact the explosive composition. The explosive composition of this detonator includes both a primary charge and a base charge.

A detonation impulse initiated by a detonator of this type would naturally propagate from a point of initiation as a growing sphere. However, with the explosive composition confined to only one side of the initiation point, the propagating impulse will be concentrated in that direction. Further, heavy confining jackets may be provided within the tubular casing to position the delay train element, and subsequently confine the explosive composition. In this manner, the detonation impulse will be encouraged to propagate in a hemispherical fashion toward the firing end of the detonator.

As a result of the volume of explosive composition required by the detonator of EP 0 439 955, the delay train element is positioned a distance from the firing end which is substantially greater than the radius of the detonator. Accordingly, a propagating spherical or substantially hemispherical impulse will impact on the wall of the firing end at various rates.

U.S. Pat. No. 5,703,319 to J. E. Fritz et al. discloses a detonator assembly comprising a conventional flat end detonator and a connector block adaptable to receive six shock tubes. The connector block includes a rounded slot proximate a location for receiving the firing end of a detonator. According to this invention, a plurality of shock tubes can be receive into the rounded slot of the connector and extend in a direction perpendicular to the detonator. The rounded slot positions the plurality of shock tubes in fixed positions with respect to the firing end of the detonator.

When six shock tubes are received into the rounded slot of the connector, the two middle shock tubes are caused to shift away from the firing end of the detonator. This allows the next two shock tubes to be positioned closer to the centerline of the detonator. As a result, the positioning of the shock tubes of the detonator assembly of this invention is not spatially uniform and as a result, the shock tubes are not positioned to receive a uniform pressure impulse. As a result, the energy transfer efficiency to each shock tube will be variable.

U.S. Pat. No. 5,204,492 to Jacob et al. teaches of a detonator assembly comprising a low strength detonator containing low brisance primary explosives such as lead azide or lead styphate or compositions thereof, and a high confinement connection block. According to the invention of this patent, an assembly is provided which increases confinement of a plurality of signal transmission lines and facilitates the transfer of a pressure impulse upon detonation, while eliminating noise and shrapnel.

The connector block designs of this invention, increase the confinement of a plurality signal transmission tubes, thereby improving the energy transfer from the detonator to the lines, and subsequently reducing the amount of explosive composition required to obtain complete initiation. However, this reference does not provide for the uniform transmission of a pressure impulse from the firing end of a detonator to all signal transmission lines held in signal communication therewith.

Published PCT patent application WO 99/46221 to J. Capers discloses a detonator assembly which includes a detonator containing an explosive charge in a section of reduced diameter and a compatible connector block. According to this invention, two series of four shock tubes can be positioned adjacent the explosive section of the detonator at an orthogonal direction to the axis of the detonator body to receive an initiation impulse upon detonation. The spatial relationship of each shock tube with the explosive section of the detonator is the same, and initiation failures are thereby reduced. Although this arrangement is an improvement over the teachings of U.S. Pat. No. 5,703,319, the manufacture of such a detonator assembly is both complicated and expensive. In addition, the shock tubes of this arrangement are generally subjected to a lower pressure impulse generated from the sided of the explosive section of the detonator. Specifically, the pressure impulse generated by the explosive section of the detonator on detonation propagates in a direction parallel to the orientation of the explosive section and tangential to the walls of the shock tubes. Accordingly, the neighbouring shock tubes of this invention are not positioned to receive the maximum pressure impulse generated by the detonator. As a result, the energy transfer of this invention is sub-optimal. Consequently, the energy of the explosive composition has to be increased by the use of high brisance compositions such as PETN, which results in the increased production of residual noise and shrapnel.

Despite previous efforts to optimize detonators and detonator assemblies to improve the reliability and safety of blasting practices, limitations in these systems remain prevalent. As a result, there is a continued need for a detonator device which can reliably initiate a plurality of conventional signal transmission lines, under a variety of environmental conditions, while producing minimal amounts of noise and shrapnel.

BRIEF SUMMARY OF THE INVENTION

It is an object of the present invention to provide a detonator device which reliably initiates a plurality of conventional signal transmission lines, under a variety of environmental conditions, while limiting the amount of residual noise and shrapnel.

It is another object of the present invention to provide a detonator device which uniformly accommodates a plurality of signal transmission lines for impulse transmission in a detonator assembly. The ability of the present invention to accommodate a plurality of signal transmission lines in a uniform impulse transmission arrangement facilitates the reliable transmission of a pressure impulse thereto.

It is a further object of the present invention to provide a detonator device with a contact wall for contacting a plurality of signal transmission for pressure impulse transmission, which is shaped to substantially correspond with the shape of a pressure impulse front generated therein.

It is a further object of the present invention to provide a detonator device capable of providing a substantially uniform pressure impulse to a plurality of signal transmission lines in impulse transmission contact therewith.

Another object of the present invention is to provide a detonator device and assembly for simultaneously initiating a plurality of signal transmission lines with a pressure impulse.

Yet another object of the present invention is to provide a detonator device and assembly adaptable to reliably initiate at least six signal transmission lines with a uniform pressure impulse.

According to one aspect of the invention, there is provided a detonator for initiating a plurality of signal transmission lines with a pressure impulse, comprising a detonator casing having a signal receiving end and a firing end, said firing end having a wall of substantially uniform thickness provided with a convex outer surface for contacting a plurality of signal transmission lines and a concave inner surface, said concave inner surface defining an inner region for holding an explosive composition, an explosive composition confined within said inner region; and means for conveying a firing signal received at said firing end to said explosive composition to initiate detonation of said explosive composition.

According to another aspect of the present invention, there is provided a detonator assembly for initiating a plurality of signal transmission lines with a pressure impulse, said detonator assembly comprising a detonator having a signal receiving end and a firing end, said firing end having a wall of substantially uniform thickness provided with a convex outer surface for contacting a plurality of signal transmission lines and a concave inner surface, said concave inner surface defining an inner region for holding an explosive composition, an explosive composition confined within said inner region, and means for conveying a firing signal received at said firing end to said explosive composition to initiate detonation of said explosive composition; and a connector element for receiving said detonator and said plurality of signal transmission lines in impulse transmission contact, said connector element comprising a conduit having opposing open ends for receiving said detonator, and a confining wall extending from one of said opposing ends to define a transverse slot for receiving said plurality of transmission lines there through; wherein when said detonator is positioned within said conduit said convex outer surface extends into said transverse slot to contact said plurality of signal transmission lines.

In accordance with yet another aspect of the present invention there is provided a connector element for connecting a detonator having an outer convex surface with a plurality of signal transmission lines, for transmission of a pressure impulse from said concave outer surface to said plurality of signal transmission lines, said connector element comprising a conduit extending through a body portion of said connector element; said conduit having opposing open ends; and a confining wall extending from one of said opposing ends and shaped to define a substantially rounded transverse slot; said transverse slot adapted to receive said plurality of signal transmission lines; and said conduit adapted to receive said detonator such that said outer convex surface of said detonator extends into said transverse slot to contact said plurality of signal transmission lines, wherein when said outer convex surface is positioned in contact with said plurality of signal transmission lines within said transverse slot, each of said plurality of signal transmission lines is uniformly positioned to receive a pressure impulse from said detonator.

By the term "uniform pressure impulse" we mean a pressure impulse having a substantially uniform strength and duration sufficient to reliably initiate a required number of signal transmission lines held in signal transmission contact with the detonator device of the present invention. For the purpose of the present invention, a pressure impulse will be sufficiently uniform when a pressure impulse is directed to impact on each point on an impulse transmission surface of the detonator of the present invention from a direction at an angle of 90±20 degrees to a tangent at each point thereon.

In accordance with a preferred aspect of the present invention, a truly uniform pressure impulse will be provided when the impulse transmission surface of the detonator device is shaped to correspond with the shape of a propagating pressure impulse front, and a uniformly confined explosive composition is initiated at a central initiation point equally distanced from all locations on the impulse transmission surface. In this case, a pressure impulse front will impact on all locations along the correspondingly shaped impulse transmission surface at a normal angle of incidence and simultaneously initiate all signal transmission lines in contact therewith. In this manner, maximum energy transfer efficiency will occur.

By the term "impulse transmission surface" we mean a wall of the firing end of a detonator of the present invention, which transmits a pressure impulse from the detonator to a plurality of signal transmission lines in contact therewith. This wall or impulse transmission surface is substantially uniform in shape and thickness, and includes correspondingly shaped exterior and interior surfaces. The interior and exterior surfaces of the impulse transmission surface cooperate to transmit a substantially uniform pressure impulse to all signal transmission lines in contact with the impulse transmission surface. The impulse transmission surface of the present invention may be any suitable shape which substantially corresponds to the shape of a pressure impulse front generated by the detonator device on which it is located. By providing a detonator device with an impulse transmission surface shaped to correspond with the shape of a pressure impulse front impacting thereon, the uniformity of the propagating impulse can be substantially maintained. Accordingly, a substantially uniform pressure impulse can be transmitted from the detonator device of the present invention to a plurality of signal transmission lines in contact with the impulse transmission surface thereof.

The present invention provides a detonator device capable of transmitting a uniform pressure impulse to all location on an impulse transmission surface. When a pressure impulse impacts on the impulse transmission surface of the detonator of the present invention, at an angle of incidence which is ±20 degrees from normal to a tangent to each point thereon, a sufficient degree of energy transfer will occur at each point to reliably initiate a signal transmission line in contact therewith. Accordingly, the present invention is adaptable to generate a uniform pressure impulse of a suitable strength and duration to reliably initiate a predetermined plurality of signal transmission lines in contact therewith. In other words, the present invention is construct to provide a uniform pressure impulse to a required plurality of signal transmission lines. Further, the present invention is capable of reliably initiating a plurality of signal transmission lines under harsh environmental conditions.

The impulse transmission surface of the present invention is preferably shaped such that each of a plurality of signal transmission lines can contact an equal portion thereof. Further, according to an aspect of the present invention a uniform explosive composition is confined to a region of the detonator device defined by an interior surface of the impulse transmission surface, such that each point on the impulse transmission surface is proximate an equal amount of an explosive composition of sufficient strength to reliably initiate an impulse transmission line in contact with that point, upon detonation.

It is known in the art, that when an explosive composition is initiated at a central point within the firing end of the detonator of the present invention, a propagating pressure impulse will travel in all directions from the point of initiation, where sufficient explosive composition is provided. The impulse transmission surface of the present invention is preferably constructed to correspond to the shape of a detonation or pressure impulse front arriving at the location of the impulse transmission surface. By further confining a uniform amount of an explosive composition in contact with an interior surface of the impulse transmission surface, a uniform pressure impulse can be transmitted through the explosive composition, from a central initiation point, to arrive at the impulse transmission surface. The shaping of the impulse transmission surface to conform with the shape of the pressure impulse front, will facilitate transmission of a uniform pressure impulse to a plurality of signal transmission lines in contact therewith.

In accordance with a preferred embodiment of the present invention, a detonator is provided with an impulse transmission surface that is hemispherical about a central initiation point, such that each point on the impulse transmission surface is an equal distance from the central initiation point within the firing end of the detonator. An explosive composition is also uniformly confined between an interior surface of the impulse transmission surface and the central initiation point. According to this embodiment of the present invention, a normal pressure impulse can impact at all points on the impulse transmission surface and simultaneously initiate the plurality of signal transmission lines in contact therewith.

The impulse transmission surface of the present invention preferably includes a convex outer surface capable of uniformly contacting a plurality of signal transmission lines at equal distances from an initiation point within the firing end of a detonator.

Where the detonator device of the present invention is employed in a detonator assembly, a plurality of signal transmission lines can be uniformly positioned in signal transmission contact with the signal transmission surface thereof. Accordingly, the signal transmission lines are positioned to receive a uniform pressure impulse.

In a preferred embodiment of the present invention, a detonator assembly is provided for reliably initiating at least six signal transmission lines with a uniform pressure impulse.

The present invention achieves reliable initiation of a plurality of signal transmission lines with minimal production of residual noise and shrapnel.

Further, the detonator assembly of the present invention reliably initiates a plurality of signal transmission lines, under extremely cold and harsh environmental conditions.

DETAILED DESCRIPTION OF THE INVENTION

Figure 1:
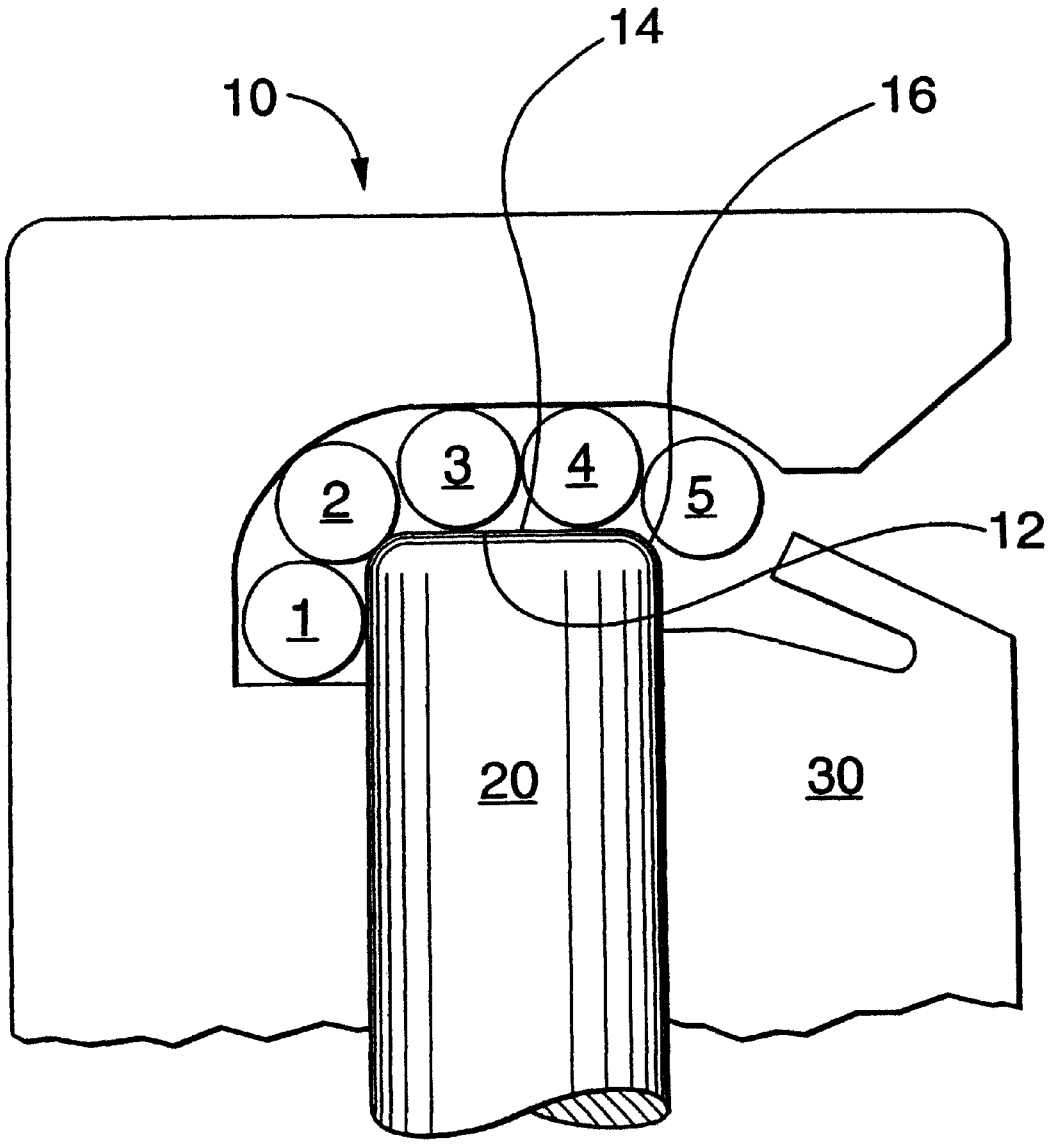
FIG. 1 PRIOR ART
FIG. 1 is a side view of a detonator assembly of the prior art.

A detonator assembly for accommodating a plurality of signal transmission lines in a uniform signal transmission arrangement is disclosed. According the present invention, each of a plurality of signal transmission lines can be uniformly positioned in signal transmission contact with the firing end of a detonator device, to receive a detonation or pressure impulse. In particular, each of a plurality of signal transmission lines can be uniformly arranged in a detonator assembly with respect to contact, confinement and orientation, to receive a substantially uniform pressure impulse.

The present invention provides a detonator device having a unique firing end construction which allows a minimal amount of an explosive composition to reliably initiate a plurality of signal transmission lines in signal transmission contact therewith. In particular, the firing end of the present invention is constructed to include a substantially uniform impulse transmission surface. The impulse transmission surface of the present invention serves to uniformly contact a plurality of signal transmission lines, facilitate the confinement of a plurality of signal transmission lines in a detonator assembly and transmit a uniform detonation or pressure impulse initiated within the detonator device to a plurality of signal transmission lines in contact therewith.

It is known in the art, that a detonation front will travel in all directions away from the point of initiation within a detonator. It is also known that by providing a homogenous mass of explosive composition within a desired location in a detonator, the detonation front will travel through the explosive composition at a relatively uniform speed.

Accordingly, a detonation front may be relatively hemispherical in shape, propagating away from a central point of initiation through an explosive composition localized at a leading end of a detonator.

The present invention provides a detonator device having a firing end substantially shaped to conform with the shape of a propagating pressure impulse generated therein. In doing so, a pressure impulse can be uniformly transmitted to a plurality of signal transmission lines in contact with the firing end of the present invention. More specifically, the firing end of the detonator device of the present invention preferably includes a contact wall of uniform shape and thickness, generally shaped to conform to the shape of a propagating detonation front. The contact wall includes corresponding shaped interior and exterior wall surfaces which cooperate to receive and subsequently transmit a propagating detonation front, from the detonator device to a plurality of signal transmission lines, respectively.

An exterior surface of the contact wall provides a contact surface or impulse transmission surface for contacting a plurality of signal transmission lines, while an interior surface of the contact wall defines an interior region for receiving an explosive composition. An explosive composition is uniformly confined to the interior region of the firing end and provides a distal edge or surface of explosive composition to be initiated by a suitable initiation means, as known in the art. For example, a suitable initiation element or assembly may be employed such that a proximal surface thereof contacts a distal surface of the explosive composition. At this point of contact between the initiation element and the explosive composition, an initiation point is defined. The contact wall is preferably shaped such that all locations thereon are equal distances from the initiation point, so as to receive a uniform pressure impulse.

According to one aspect of the present invention, the detonator device includes the contact wall having corresponding concave and convex surfaces to receive and subsequently transmit a propagating detonation front, respectively. By confining the explosive composition to the interior region of the firing end, defined by the interior, concave surface of the contact wall and providing a central initiation point along a distal horizontal surface of the explosive composition, a substantially uniform hemispherical detonation or pressure impulse front can be caused to impact on the contact wall. Corresponding concave and convex surface may further provide substantially uniform transmission of the pressure impulse to a plurality of signal transmission lines in contact therewith.

Accordingly, a detonator device of the present invention may transmit a uniform pressure impulse to a plurality of signal transmission lines in contact therewith. When the signal transmission lines are uniformly arranged in signal transmission contact with the detonator device of the present invention, a uniform pressure impulse of sufficient strength to ensure initiation, may be transmitted thereto. As a result, reliable initiation of a plurality of signal transmission lines can be repeatedly obtained with a detonator device of the present invention.

It is commonly known that the reliable initiation of a plurality of signal transmission lines is dependent upon the strength of the detonator, the design of the detonator and the degree of confinement of the signal transmission lines with respect to an impulse transmission surface of a detonator. A balance of these factors must be achieved to obtain an optimal transfer of energy from the detonator to all of the signal transmission lines, with minimal residual noise and shrapnel. More importantly, a minimum energy transfer threshold must be met at each location of a signal transmission line provided in contact with the impulse transmission surface, to ensure complete initiation of all signal transmission lines.

The uniform positioning of a plurality of signal transmission lines in signal transmission contact with a detonator device of the present invention may be accommodated by a connector block or element. In accordance with an embodiment of the present invention a connector block is disclosed which accommodates the firing end of the detonator herein disclosed, to provide a plurality of signal transmission lines in contact with an outer surface of the contact wall or impulse transmission surface located thereon. The connector block of the present invention facilitates the uniform positioning of a plurality of signal transmission lines in contact with the shaped firing end of the detonator device of the present invention, while maintaining uniformity in the confinement of each line.

For the purpose of this invention, a detonator assembly refers to a detonator device as taught by the present invention provided with a connector block adaptable to receive the detonator device in impulse transmission contact with a plurality of signal transmission lines to be initiated by a pressure impulse. In a detonator assembly, confinement of the signal transmission lines refers to the degree of support with which a signal transmission line is held in contact with the firing end of a detonator. For example, under the impact of a detonation or pressure impulse, a connector block may be caused to expand in the direction of the impulse, and subsequently decrease the degree of support provided to one or several signal transmission lines. According to an embodiment of the present invention, there is provided a connector block which is adaptable to receive a plurality of signal transmission lines in a uniform arrangement for impulse transmission contact with the detonator device as disclosed herein. Further, the connector block as herein disclosed is adapted to position each of the signal transmission lines in uniform confinement when in impulse transmission contact with the detonator device disclosed herein.

Where one signal transmission line is provided in an optimally confined position with respect to the impulse transmission surface of a detonator, the energy transfer to that line will be more efficient. As a result, that line is more likely to become initiated than other less preferably confined transmission lines. In other words, signal transmission lines positioned with sub-optimal confinement, are less likely to be reliably initiated within a blasting system. When a detonator device is unable to accommodate a plurality of signal transmission lines with uniform signal transmission contact and confinement, an increased amount of explosive composition must be employed to overcome the variability and initiate all of the signal transmission lines.

By providing a uniform impulse transmission surface, each signal transmission line can be positioned in contact with an equal surface area of the transmission surface, and can be more optimally confined within a connector block. In addition, a uniform impulse transmission surface will reduce the variability encountered by a pressure impulse propagating from an initiation point within the detonator device. As a result, the variability in support, contact and energy transfer efficiency to the signal transmission lines can be minimized.

In a preferred embodiment, a detonator assembly of the present invention is adaptable to accommodate at least six signal transmission lines in a uniform arrangement with the impulse transmission surface of a detonator device, for reliable and safe detonation thereof.

According to an embodiment of the present invention, the detonator device of the present invention provides an impulse transmission surface having uniform shape and thickness. The uniform shape of the impulse transmission surface generally comprises a convex outer surface and a corresponding concave inner surface. The concave inner surface serves to define a concave inner region for receiving an explosive composition. The explosive composition is confined within the inner region to provide a hemispherically packed homogenous explosive composition. An initiation assembly is provided to contact the explosive composition along a distal edge thereof. Preferably, the initiation assembly contacts the explosive composition at a central location proximate the impulse transmission surface to provide a central initiation point.

Upon detonation, a propagating pressure impulse will propagate as a growing hemisphere from the initiation point to sequentially encounter the concave inner surface and convex outer surface of the uniform impulse transmission surface, respectively. Accordingly, to the extent that the shape of the impulse transmission surface conforms to the shape of the propagating pressure impulse, a generally uniform pressure impulse will be transmitted to a plurality of signal transmission lines in contact therewith.

By controlling the uniformity of the transmission pathway of the propagating pressure impulse and the positioning of the signal transmission lines to be initiated, the present invention can ensure that a suitable degree of energy transfer efficiency is obtained to reliably initiate a required number of signal transmission lines. In essence, the present invention substantially eliminates the variability experienced in conventional detonator assemblies.

In a preferred embodiment, the detonator device of the present invention predominantly employs a primary or low energy explosive composition, for reliably and safely initiating a plurality of signal transmission lines with minimal noise and residual shrapnel, as compared with detonators of the prior art. By confining the explosive composition to an inner region of the detonator which substantially conforms to the shape of a propagating pressure impulse, proximate the impulse transmission surface, the amount of an explosive composition required to achieve complete initiation of a predetermined number of signal transmission lines can be reduced.

The detonator device of the present invention may be manufactured to accommodate virtually any number of signal transmission lines. The amount and type of explosive composition contained within the detonator device of the present invention may be varied to suitably accommodate the number of signal transmission tubes. The detonator device of the present invention may be employed in connection with a conventional connector block within a detonator assembly, to reliably initiate a plurality of signal transmission lines. However, the detonator device of the present invention is preferably employed with a connector block as herein disclosed. In particular, the detonator device as herein disclosed is preferably employed with a connector block having a rounded slot adaptable to receive a plurality of signal transmission lines in a uniform contact arrangement with a convex exterior surface located on the firing of the detonator. Accordingly, when the present invention is employed as a detonator assembly, a plurality of signal transmission lines can be uniformly positioned in signal transmission contact with the firing end of the detonator device to receive a detonation or pressure impulse. In particular, the present invention positions a plurality of signal transmission lines to receive and be initiated by a uniform pressure impulse.

This feature of the present invention is a significant improvement over similar devices of the prior art which, do not accommodate the uniform arrangement and initiation of a plurality of signal transmission lines.

It is an objective of the present invention to maintain the uniformity of a propagating pressure impulse, in order that a plurality of signal transmission lines in impulse transmission contact with the present invention may receive optimal and uniform energy transfer therefrom. In order to optimize the energy transfer efficiency of the propagating detonation or pressure impulse, the signal transmission surface of the firing end may be shaped to match the shape of the impulse, thereby facilitating the ability of the pressure impulse to impact the transmission surface simultaneously at all locations thereon.

The pressure impulse, as generated by the present invention will simultaneously impact on the impulse transmission surface when the impulse is initiated at a central point to all locations on the surface, and when the shape of the surface is identical to the pressure impulse front. However, in accordance with this invention, it has been determined, that the energy transfer of a detonator device is optimized when the transmission surface is generally shaped to match the shape of the pressure front of a growing impulse and an initiation impulse is initiated within the detonator at a central location with respect thereto.

In other words, the reliability of initiating a plurality of signal transmission lines in a detonator assembly, is significantly improved when a pressure impulse can be transmitting to a plurality of signal transmission lines along uniform impulse transmission pathways. According to the present invention, a plurality of signal transmission lines are uniformly positioned with respect to a point of impulse initiation, and an impulse transmission surface on the firing end of a detonator is generally shaped to match the shape of the pressure impulse impacting on the signal transmission lines.

The impulse transmission surface of the present invention is preferably, uniformly constructed such that a propagating pressure impulse would encounter the same degree of conductivity at all transmission points or pathways there along. The transmission surface has a uniform diameter and composition thus providing a plurality of identical transmission pathways. Accordingly, if a pressure impulse is initiated at a central location with respect to the transmission surface, a propagating pressure impulse would simultaneously arrive at the transmission surface and transmit there across via the plurality of transmission pathways. The uniform construction of the transmission surface would subsequently allow the propagating pressure impulse to uniformly traverse the transmission surface and encounter a plurality of signal transmission lines positioned thereto.

An embodiment of the present invention further provides a detonator device having an impulse transmission surface of a substantially uniform construction, where all transmission points on the transmission surface are generally equally distanced from an impulse source or initiation assembly within the detonator device. This uniform construction of the impulse transmission surface is further provided to correspond to the general shape of a pressure impulse or detonation front impacting on the plurality of signal transmission lines held in transmission contact therewith.

As a result, a uniform detonation or pressure impulse propagating from the central impulse source or initiation assembly impacts the signal transmission surface of the firing end at all locations thereon. In a preferred embodiment of the present invention, the uniform detonation or pressure impulse impacts the signal transmission surface of the firing end of the detonator device in a normal, or perpendicular direction at all locations, and simultaneously imparts a maximum energy transfer to all signal transmission lines in transmission contact therewith. Accordingly, all of the signal transmission lines are simultaneously initiated.

The present invention will first be described with respect to its function in a detonator assembly. For the purposes of the description of the present invention, a detonator assembly refers to a detonator positioned for signal communication with a plurality of signal transmission lines in a connector block. Such a connector block will accommodate a plurality of signal transmission lines in signal transmission contact with the firing end of the detonator, and in particular with the impulse transmission surface located on the firing end.

Also for the purpose of this description, a blasting system refers to a plurality of detonator assemblies arranged in signal communication for the timely initiation of a plurality of blasts at a variety of blasting locations, which may include both above ground locations and within boreholes. It should, however, be understood that this invention is not limited to the arrangements described herein for the purpose of illustration. In particular, the detonator device as herein described is adaptable for use in a variety of blasting arrangements and systems.

For the purposes of this invention, reference to signal transmission lines may include conventional signal transmission lines, shock tubes or similar transmission means routinely associated with the transmission of a energy impulse in blasting systems.

Further, the detonator device as herein described is adaptable to house a variety of explosive compositions and elements necessary for generating a desired detonation impulse and subsequent blast. For example, the detonator device of the present invention may include a suitable amount of low energy explosive in communication with a delay element, and an input shock tube. In accordance with one embodiment of the present invention, a single low brisance primary explosive, such as lead azide or lead styphnate, is preferably employed to reduce the amount of residual noise and energy shrapnel generated upon detonation. Alternatively, however, small quantities of higher energy explosives, such as PETN, may be added to increase the power of the detonator device of the present invention. The present invention is not, however, limited in any way by the compositions and elements in which it may contain for the purpose of generating a blast.

The detonator device of the present invention reliably initiates a plurality of signal transmission lines with a uniform pressure impulse. As defined above, for the purpose of the description of the present invention, a uniform pressure impulse is substantially uniform in strength and duration to a degree sufficient to reliably initiate a required number of signal transmission lines held in signal transmission contact with the detonator device of the present invention. In particular, for the purpose of the present invention, a pressure impulse will be sufficiently uniform when a pressure impulse is directed to impact on each point on an impulse transmission surface of the detonator of the present invention from a direction at an angle of 90±20 degrees to a tangent at each point thereon.

Upon initiation, a high pressure, high temperature detonation front or pressure impulse is generated within the firing end of the detonator device. This pressure impulse propagates through the explosive material confined within the firing end of the detonator device to contact the impulse transmission surface. The propagating pressure impulse traverses the impulse transmission surface of the firing end to impact on the neighbouring signal transmission lines.

The shape of the propagating pressure impulse will remain uniform until it impacts on an interference or obstacle in its transmission pathway. If the interference or obstacle does not impact on the entire circumference of the propagating impulse, the shape of the pressure front or pressure impulse will become distorted accordingly. Alternatively, if the entire impulse front encounters a uniform interference, the entire pressure impulse will experience the sane degree of resistance and uniformity will be maintained.

As mentioned above, the dynamics of a pressure impulse are such that it will propagate at a uniform velocity in all directions from its point of initiation. Therefore, the propagation time of the pressure impulse will be determined by the distance traveled along each transmission pathway radiating from the point of initiation. Accordingly, if all transmission pathways leading from the point or source of initiation to each of the signal transmission lines is substantially uniform, the pressure impulse should simultaneously impact on each line with uniform strength and magnitude. The duration of the pressure impulse is directly determined by the quantity of the explosive composition employed to generate the detonation.

In a preferred aspect of the present invention, the detonator device is constructed to concentrate a pressure impulse towards a corresponding impulse transmission surface positioned at equal distances from a central initiation source. When the impulse transmission surface is shaped to conform with the shape of the detonation or pressure front directed thereto, the pressure impulse should simultaneously impact on the impulse transmission surface in a normal direction at all locations on the transmission surface. In other words, the pressure impulse propagates from the central initiation source to encounter the signal transmission surface of the detonator device at a substantially perpendicular angle.

According to the present invention, a detonator device having a predetermined size and strength, can reliably initiate a corresponding plurality of signal transmission lines positioned in impulse transmission contact with the detonator device in a suitable detonator assembly by transmitting a pressure impulse which has uniform strength and duration.

FIG. 1 illustrates a conventional detonator assembly 10 including a detonator 20 (shown in partial view), held in connection with a plurality of signal transmission lines 1, 2, 3, 4, and 5, by a connection block 30. In this arrangement, the signal transmission lines 1 to 5 are aligned in a J-shape about firing end 12 of the detonator 20.

Typically, the firing end of modern, non-electric detonators employed in conventional blasting systems has a flat end surface 14 with a cross section corresponding to the diameter and shape of the detonator body. The prior art has disclosed the shaping of the firing end of detonators, for example the rounding of the corners of the firing end to facilitate positioning within connector blocks and other blasting system components. However, these prior art detonators are not able to uniformly accommodate at least five signal transmission lines in impulse transmission contact, nor transmit a uniform pressure impulse therefrom.

As shown in FIG. 1, the firing end 12 of detonator 20 has a flat end surface 14, with rounded corners 16. In this arrangement, the plurality of signal transmission lines 1 to 5, can not be uniformly arranged in impulse transmission contact with firing end 12. Each signal transmission line illustrated in FIG. 1 is positioned in contact with firing end 12 having a variable degree of contact length thereon. Further, a pressure impulse initiated within the firing end 12 of this detonator 20 will encounter non-uniform transmission ways to the location of each of the signal transmission lines. That is to say, a propagating pressure impulse will travel along pathways having variable length and energy transfer efficiency to arrive at each of the plurality of signal transmission lines. In fact, according to this arrangement, a maximum initiation stimulus or pressure impulse would be transmitted to signal transmission lines 3 and 4 upon detonation of detonator 20. Transmission lines 3 and 4 are positioned proximate the area of firing end 12 having the greatest diameter and at which transmission of a pressure impulse will occur in a normal or perpendicular direction. As a result, the pressure impulse will propagate from an initiation point within firing end 12 at an angle perpendicular to the transmission surface in impulse transmission contact with signal transmission lines 3 and 4, and impart a maximum stimulus thereto. On the other hand, signal transmission lines 2 and 5 are positioned to experience a weaker pressure impulse upon detonation of the explosive composition contained within the detonator as the pressure impulse will travel at an acute angle to these locations proximate firing end 12. The thick metal corners of the detonator 20 at firing end 12 proximate signal transmission lines 2 and 5 will further interfere in the transmission of the pressure impulse to these locations and contribute to the weakened impulse received by these lines. At these corner locations of firing end 12, signal transmission lines 2 and 5 are subjected to a reduced area of the transmission surface of firing end 12. In addition, the decreased confinement of line 5, proximate the entry point of the connector block 30 is of further detriment to the pressure impulse received by this line.

In the arrangement of FIG. 1, signal transmission line 1 is positioned with the best confinement for the purposes of receiving an impulse from detonator 20. In particular this line is held in close proximity to the firing end 12 by a thick outer wall of the connector block 30. Preferred confinement would be achieved where a signal transmission line is securely positioned to receive a normal impulse transmission along a pathway of minimal interference. Assuming that the pressure impulse is spherical, centering at the end of an initiation element (not shown) centrally located proximate the firing end of detonator 20, the pressure impulse would propagate in a near normal direction to signal transmission line 1, provided that line 1 is proximate a sufficient amount of explosive material in firing end 12.

The detonator assembly 10 of FIG. 1, does not provide a uniform pressure impulse to all of the signal transmission lines positioned proximate thereto. As a result, detonator assembly 10 of FIG. 1 is more prone to experience initiation failures when a signal transmission line is not adequately positioned with respect to the firing end 12.

The firing end of the present invention provides for a plurality of signal transmission lines to be accommodated in a conventional connector block with improved confinement. In addition, the firing end of the present invention is constructed to facilitate uniform transmission of a pressure impulse from a location of an initiation source within the firing end to a contact wall or impulse transmission surface located thereon. By optimizing the confinement of the signal transmission lines, and providing a firing end with generally uniform construction, the present invention is able to reliably initiate a plurality of signal transmission lines, even when employed in connection with a conventional connector block. However, improved initiation results are expected when the detonator device of the present invention is employed in a compatible connector block as herein disclosed.

The detonator device of the present invention can be constructed to have a predetermined size and strength, and can reliably initiate a corresponding number of signal transmission lines positioned in impulse transmission contact with the detonator device, in a suitable detonator assembly. The strength of the pressure impulse generated by the present invention is directly proportional to the type and amount of explosive material contained in the detonator device. Preferably, the amount of explosive material contained within the detonator device of the present invention will be optimized to provide a pressure impulse of sufficient strength and duration to reliably initiate a predetermined number of signal transmission lines within a detonator assembly, while minimizing the amount of noise and shrapnel generated.

In accordance with a preferred embodiment of the present invention, a primary explosive such as lead azide or lead styphnate is employed as the explosive material. By employing a primary explosive as the sole explosive material, the amount of explosive required is reduced, and the residual noise and shrapnel is minimized. In addition to reducing the amount of residual noise and shrapnel generated, the reduced amount of explosive composition required by the present invention has the further advantage of allowing the initiation assembly to extend closer to the firing end of the detonator device. The initiation assembly is preferably centrally positioned with respect to the impulse transmission surface on the firing end of the detonator such that a proximal surface of the initiation assembly contact a distal surface of the explosive composition uniformly packed therein. In this manner, an initiation point can be provided which is substantially equally distanced from all locations on the impulse transmission surface. Detonators of the prior art generally employ larger amounts of an explosive composition which hinder the ability to position the initiator element in a central location about the firing end.

Alternatively, a primary explosive can be employed in an explosive composition with a minimal amount of secondary explosive, to provide a detonation of a larger magnitude. However, even when this type of explosive composition is employed, a smaller quantity of explosive is required compared to detonator devices of the prior art.

The detonator device of the present invention provides a uniform pressure impulse to a plurality of signal transmission lines within a detonator assembly, upon detonation thereof. As a result, the detonator device of the present invention can be employed within a blasting system to reliably and safely initiate a plurality of signal transmission lines. In doing so, the present invention requires less explosive material than conventional detonator devices to initiate a predetermined number of signal transmission lines.

In essence, the unique construction of the detonator device of the present invention maximizes the energy transfer from the detonator to the signal transmission lines, thereby achieving the reliable initiation of a plurality of signal transmission lines with an amount of explosive which is less than that employed by conventional detonator devices of this type. This reduction in explosive material contributes to a subsequent reduction in the quantity and energy of shrapnel produced upon detonation, which may potentially damage adjacent shock tubes in a blast system. The present invention also provides reliable initiation of a plurality of signal transmission tubes in communication with a detonator assembly under cold, harsh environmental conditions.

In addition, the present invention is capable of reliably initiating a plurality of signal transmission lines within a detonator assembly under extremely harsh operating conditions. Test results have indicated that the present invention provides reliable initiation of a plurality of signal transmission lines at temperatures of −60° C. As mentioned above, the present invention can be manufactured in a variety of sizes to accommodate different amounts of an explosive composition, and subsequently accommodate a corresponding number of signal transmission lines within a detonator assembly.

The present invention is not herein limited by the number of signal transmission lines employed in the drawings and description of this application. According to one embodiment of the present invention, at least six signal transmission lines can be accommodated by the detonator assembly as herein disclosed and the individual components thereof. It is fully contemplated, however, that the necessary adaptations can be made to the detonator device and connector block of the present invention to accommodate any reasonable number of signal transmission lines.

Figure 2:
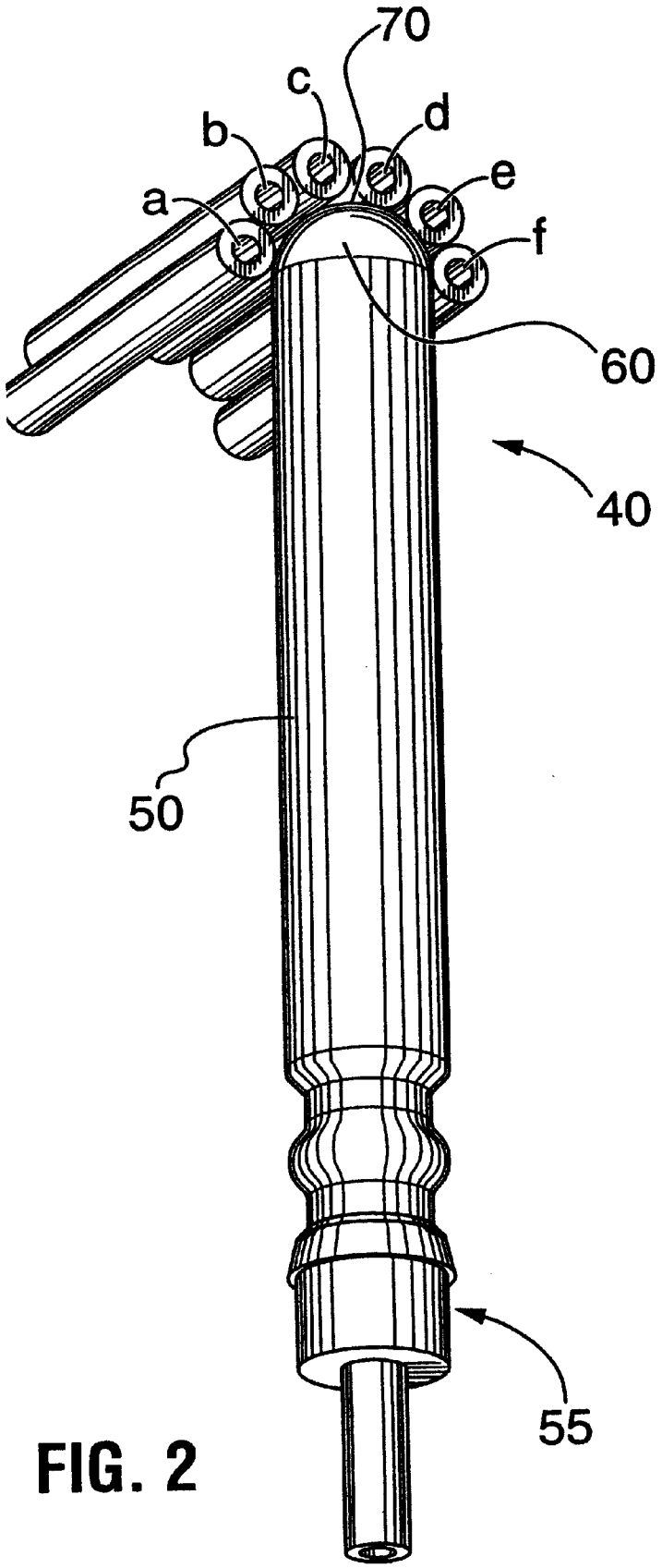
FIG. 2 is a three dimensional view of an embodiment of the present invention.

As illustrated in FIG. 2, the present invention provides a novel detonator device 40. Detonator 40 of the present invention includes a cylindrical body 50 extending between a first receiving end 55 and a second firing end 60. The firing end 60 is constructed to provide a uniform signal transmission surface 70. In accordance with conventional practices, the cylindrical body 50 of detonator 40 is adaptable to accommodate a plurality of pyrotechnic and explosive devices, elements and compositions as deemed necessary for generating a suitable blast or pressure impulse, via receiving end 55. For example, detonator 40 would at least contain an explosive composition, for example, lead azide, uniformly packed within firing end 60, in connection with a suitable initiation assembly known in the art. Receiving end 55 would be subsequently crimped or closed in any suitable fashion upon receiving the appropriate components therein.

According to the embodiment of FIG. 2, the firing end 60 is a hemispherical extension of cylindrical body 50 of detonator 40. This uniform, hemispherical extension allows a plurality of signal transmission lines (a, b, c, d, e, f) to be evenly positioned around the circumference of the hemispherical firing end 60 when arranged in a detonator assembly (not shown). In particular, signal transmission lines (a, b, c, d, e, f) would be held in impulse transmission contact with an impulse transmission surface 70 located along the exterior circumference of a firing end 60. Typically, signal transmission lines (a, b, c, d, e, f) are positioned in impulse transmission contact with a firing end 60 of a detonator 40 by a connector block, in order to receive a suitable degree of an initiation impulse upon detonation.

Figure 3:
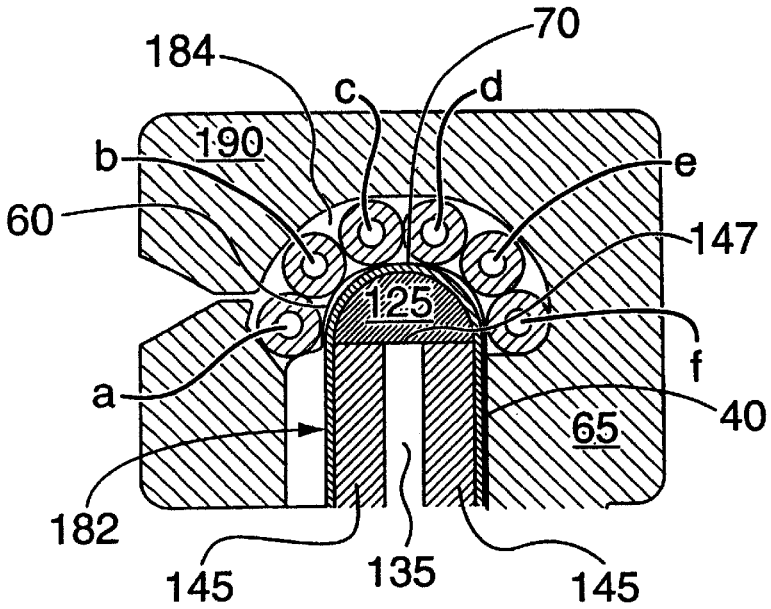
FIG. 3 is a cross section of a detonator assembly of the present invention.

A cross-section of a detonator assembly of the present invention is illustrated in FIG. 3. Here, detonator 40 is positioned in impulse transmission contact with six signal transmission lines (a, b, c, d, e, f) by a connector block 65. Connector block 65 includes an inner channel or conduit 182 for receiving a detonator 40. A confining wall 190 extends from one end of the connector block 65 to define a transverse slot 184 traversing one of two opposing open ends of the conduit 182. The transverse slot 184 is a generally rounded receiving slot for receiving a plurality of signal transmission lines in contact with firing end 60 of detonator 40. Transverse slot 184 is preferably hemispherical in shape but may be any suitable shape for receiving the firing end of the detonator of the present invention in uniform contact with a required plurality of signal transmission lines. The shape of transverse slot 184 is substantially defined along a proximal surface by confining wall 190. When a detonator 40 is in connection with connector block 65, firing end 60 extends into transverse slot 184 and serves to further define the shape thereof. A plurality of signal transmission lines (a, b, c, d, e, f) can be subsequently received by slot 184, in impulse transmission contact with the firing end 60. Confining wall 190 facilitates the uniform confinement of a plurality of signal transmission lines with respect to firing end 60 of detonator 40.

Similar to the embodiment of FIG. 2, the firing end 60 of detonator 40 as illustrated in FIG. 3 is a hemispherical extension of cylindrical body 50. As such, the diameter of the firing end 60 is substantially equal to the diameter of the cylindrical body 50 and a hemispherical impulse transmission surface 70 is provided. A detonator 40 according to this embodiment of the present invention may be referred to as a round bottom detonator.

According to the illustration of FIG. 3, impulse transmission surface 70 has a uniform shape and thickness and includes a convex outer surface and a corresponding concave inner surface. An explosive composition 125 is uniformly confined to a region of the firing end defined by the concave inner surface and in contact with an initiation assembly 135 along a distal edge. An initiation point 147 is defined by the contact point of the initiation assembly 135 and the explosive composition 125.

Explosive composition 125 is uniformly confined to the region of the firing end defined by the concave inner surface of the impulse transmission surface 70 to ensure that a uniform transmission pathway is provided to each location thereon. As mentioned above, impulse transmission surface 70 is provided with a uniform wall thickness. In this manner, a pressure impulse can propagate through the explosive composition 125 along substantially uniform transmission pathways to each location of the plurality of signal transmission lines.

According to the embodiment of FIG. 3, an explosive composition 125 will be uniformly packed within the region defined by the concave inner surface of the impulse transmission surface 70 to provide a generally hemispherical packed explosive composition 125. Initiation assembly 135 will subsequently contact the packed explosive composition along a distal surface, to define an initiation point 147.

According to a preferred embodiment of the present invention, the initiation assembly 135 is centrally positioned with respect to the impulse transmission surface 70 such that all locations on the surface 70 are equally distanced from the initiation assembly 135. According to this embodiment, a propagating pressure impulse will uniformly impact on the impulse transmission surface 70 in a normal direction at all locations thereon.

In this arrangement, a normal pressure impulse will propagate from the central initiation point 147 in the shape of an expanding hemisphere, toward the impulse transmission surface 70. This propagating pressure impulse will impact on the impulse transmission surface 70 at a normal angle (ie. at 90 degrees) and simultaneously initiate the signal transmission lines in contact with the outer convex surface. According to this embodiment, maximum energy transfer from the detonator device to the plurality of signal transmission lines is achieved.

Each point on the impulse transmission surface will expand with detonation, thereby progressively compressing an increasing portion of the adjacent signal transmission line. By ensuring that each signal transmission line is equally positioned with respect to the impulse transmission surface 70 of detonator 40, each line will experience substantially the same degree of compression upon detonation. Accordingly, the present invention accommodates the positioning of a plurality of signal transmission lines to receive a uniform and reliable initiation pressure impulse thereto, thus greatly reducing the number of failed initiation attempts.

In addition, as a result of the uniform construct of firing end 60, a round bottom detonator 40 provides a fisher convenience in the arrangement of the detonator assembly in that detonator 40 can be easily and quickly positioned within a connector 65 without requiring alignment of detonator 40 with respect to the direction of incoming signal transmission lines (a, b, c, d, e, f).

Detonator 40 as illustrated in FIG. 3, includes several conventional detonator components including an initiation assembly 135 centrally positioned within the detonator body 50 by jacket 145. As mentioned above, the detonator 40 of the present invention is adaptable to include a variety of explosive compositions and components known in art to achieve an initiation pulse of the require strength and duration. In accordance with a preferred embodiment of the present invention, explosive composition 125 is a low energy explosive composition. In addition, the initiation element 135 may be a pyrotechnic delay material for controlling the timing of the initiation. Likewise, the jacket 145 may be a delay element housing comprised substantially of lead, which serves to maintain the pressure impulse and concentrate the energy thereof in the direction of the firing end 60 or any other suitable material known in the art.

As illustrated in FIG. 3, the firing end 60 is hemispherical in shape, having a radius equal to that of the detonator body 50. Alternatively, however, the firing end 60 may be virtually any uniform convex shape capable of uniformly accommodating a plurality of signal transmission lines in impulse transmission contact. By providing a detonator device having an exterior convex firing end, a plurality of signal transmission lines can be more uniformly positioned to receive a pressure impulse therefrom. Further, when the uniform impulse transmission surface 70 of the present invention is shaped such that each point located thereon is equally distanced from an initiation assembly located within the detonator, a substantially uniform pressure impulse may simultaneously impact thereon.

Figure 4:
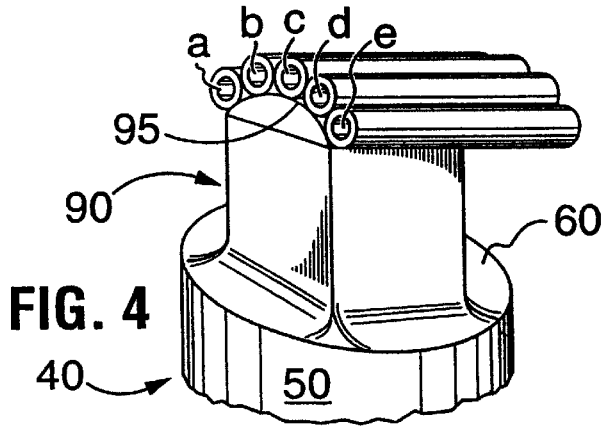
FIG. 4 is a three dimensional view of an embodiment of the present invention.

FIG. 4 illustrates another embodiment of the present invention which provides a detonator device 40 having a semi-cylindrical shaped tip 90 at firing end 60. Semi-cylindrical shaped tip 90 extends from a cylindrical detonator body 50 and serves to provide a curved transmission surface 95 for impulse transmission contact with a plurality of signal transmission lines. More specifically, semi-cylindrical shaped tip 90 includes a body portion 110 and may be provided as a non-uniform extension of the cylindrical detonator body 50. For example, and according to the illustration of FIG. 4, semi-cylindrical shaped tip 90 may extend slightly inward from the outer edge of cylindrical detonator body 50, having a diameter and length which are less than that of the detonator body 50

In accordance with this embodiment of the present invention, each of a plurality of signal transmission lines (a, b, c, d, e,) is exposed to an increased contact area or length on transmission surface 95, compared with the hemispherical firing end 60 of the previous embodiment. As illustrated in FIG. 4, the curved geometry of semi-cylindrical shaped tip 90 allows a plurality of signal transmission lines to be uniformly positioned proximate the firing end 60 of detonator device 40. Such uniform positioning proximate transmission surface 95 facilitates the transfer efficiency of a pressure impulse over conventional flat end detonators. The energy transfer of this embodiment is further improved by the increased contact area available to each signal transmission line, with the firing end.

The semi-cylindrical shaped tip 90 is a more mechanically complex alternative to the previous embodiment. However, it is included in the description to illustrate that alternatives to the hemispherical or otherwise convex firing end which provide an increased contact area or length for the signal transmission lines is not devoid from the present invention.

Accordingly, the internal structure of the embodiment of FIG. 4 would be similar to that of the embodiment of FIG. 3 where an initiation assembly would extend from the detonator body into the semi-cylindrical tip and contacts the explosive composition at an axial location thereof, in line with opposing ends of transmission surface 95.

The semi-cylindrical shaped tip 90 of the present invention may be manufactured by a variety of techniques, including being molded from plastic.

Curved transmission surface 95 accommodates a plurality of signal transmission lines in preferred confinement within a connector block. In addition to being uniformly positioned in impulse transmission contact with transmission surface 95 of semi-cylindrical shaped tip 90, each of a predetermined number of signal transmission lines are in signal communication with an equal area or length thereon. Further, semi-cylindrical shaped tip 90 has a generally uniform wall thickness across its entire transmission surface 95. In accordance with this embodiment, a pressure impulse initiated in detonator 40 at an axial location in line with the location of the two lowest signal transmission lines (a and e) at opposing end of signal transmission surface 95 would impact on the curved transmission surface 95 in a substantially normal direction at all locations on signal transmission surface 95. In doing so, a uniform pressure impulse is delivered to all signal transmission lines over identical contact lengths.

Although the preceding round bottom detonator also provides the uniform positioning of a plurality of signal transmission lines proximate a curved transmission surface, its hemispherical tip at firing end 60 provides each neighbouring transmission line with a contact point, oppose to a contact length as shown in FIG. 4, from which a pressure impulse will be transmitted.

The increased contact lengths available to signal transmission lines (a, b, c, d, e,) with the semi-cylindrical shaped tip embodiment contribute to a further aspect of the present invention, whereby a reduced amount of explosive is needed to generate a pressure impulse of sufficient strength, duration and magnitude to successfully and reliably initiate all of the signal transmission lines positioned proximate thereto. That is, according to this embodiment of the present invention a plurality of signal transmission lines can be reliably initiated with less amount of explosive than that required by conventional detonators.

Figure 5:
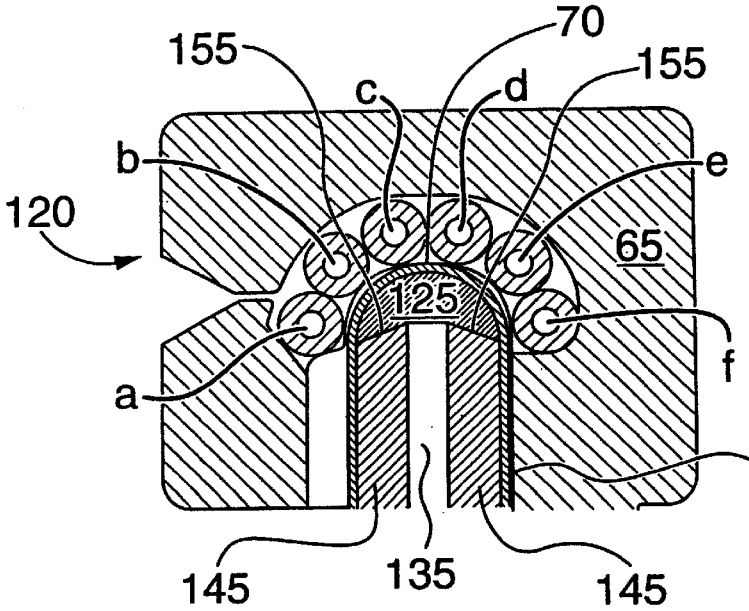
FIG. 5 is a cross section of still another embodiment of the present invention.

According to another embodiment of the present invention, the amount of explosive required to reliably initiate a plurality of signal transmission lines with a uniform initiation impulse, may be further reduced. FIG. 5 illustrates a detonator assembly 120 in cross section, comprising a detonator 130 which is held in impulse transmission contact with a plurality of signal transmission lines by a connector block 65. Detonator 130 is a round bottom detonator of the present invention having a hemispherical firing end 60 which is a uniform extension of the cylindrical detonator body 50. As illustrated in FIG. 5, round bottom detonator 130 includes an explosive composition 125 contained in hemispherical firing end 60, and a delay element 145 containing a pyrotechnic delay material 135. As shown for the purpose of illustration, the curved transmission surface 70 of hemispherical firing end 60 accommodates six signal transmission lines (a, b, c, d, e, f) in a detonator assembly 120 in a uniform impulse transmission contact. However, according to this embodiment of the present invention, the delay element 145 is provided with a chamfered leading edge 155.

In order to provide a plurality of signal transmission lines with a substantially uniform pressure impulse, a sufficient quantity of explosive composition 125 must be confined to the inner region of the firing end proximate the the curved transmission surface 70. That is, a uniform and sufficient amount of explosive must be provide proximate each location of a signal transmission line in impulse transmission contact with surface 70. For example, a round bottom having an outside diameter of approximately 7 5 mm and an inside diameter of approximately 6.65 mm which is devoid of a delay element having a chamfered leading edge, will require approximately 200 mg of an explosive composition within hemispherical firing end 60 in order to generate a uniform pressure impulse to all six signal transmission lines (a, b, c, d, e, f).

According to the embodiment of the present invention, as illustrated in FIG. 5, a chamfered leading edge or surface 155 of delay element 145 serves to compact a smaller quantity of an explosive composition 125 into position within the inner region of firing end 60 in a substantially uniform manner for the reliable initiation of at least six signal transmission lines within detonator assembly 120. In doing so, the inner region of the firing end 60 containing the explosive composition will extend past a 180 degree distal edge to extend sufficient explosive material to the most distal locations on the impulse transmission surface 70. For example, a round bottom detonator having an outside diameter of approximately 7.5 mm and an inside diameter of approximately 6.65 mm and including a delay element 145 having a chamfered leading edge 155 can compact approximately 150 mg of an explosive composition 125 within hemispherical firing end 60 such that a sufficient quantity of the explosive composition is forced to extend back to the area of the firing end 60 proximate the two lowest signal transmission lines (a, f) to provide a uniform pressure impulse to all six signal transmission lines upon initiation.

Figure 6:
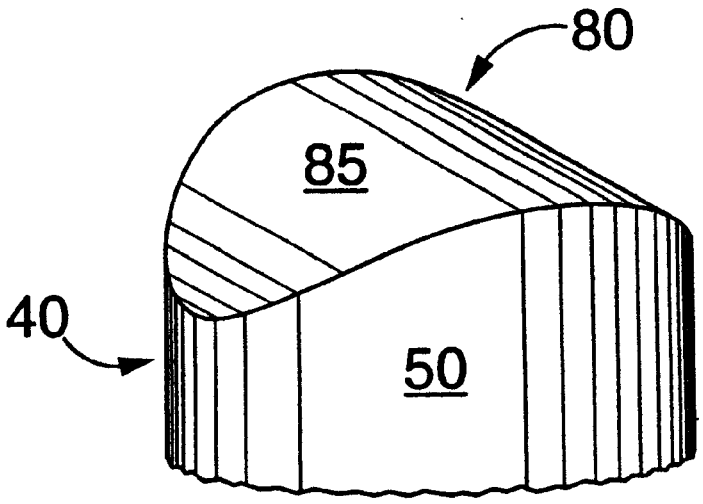
FIG. 6 is a three dimensional view of another embodiment of the present invention.

Another embodiment of the present invention as illustrated in FIG. 6 provides a detonator 40 having a curved firing end 80. The firing end 80 of this embodiment serves to replace a conventional flat cylindrical firing end to provide a curved transmission surface 85. This embodiment provides an increased area for impulse transmission contact with signal transmission lines, while improving the uniformity of arrangement and confinement of signal transmission lines proximate thereto in a detonator assembly, compared to detonators of the prior art. Further, firing end 80 of this embodiment also accommodates a reduction in the amount of explosive required to reliably initiate a plurality of signal transmission lines in a detonator assembly, compared to conventional detonators.

Figure 7:
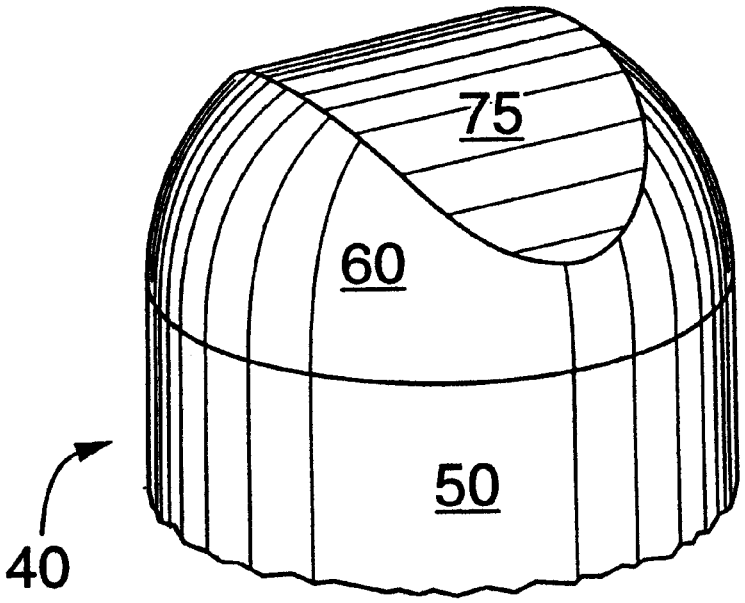
FIG. 7 is a three dimensional view of yet another embodiment of the present invention.

According to yet mother embodiment of the present invention, as illustrated in FIG. 7, the firing end 60 of a round bottom detonator 40 may included a curved impulse transmission surface 75 which is not uniform with the curvature of the firing end 60. Although the exterior width of the impulse transmission surface 75 is not uniform, the contact length which is available for each of a plurality of signal transmission lines is nevertheless greater than that of a uniform round bottom detonator. In the latter case, the contact length or area is theoretically a single point on the transmission surface. As such, the signal transmission lines proximate a firing end 60 having a impulse transmission surface 75 which is not uniform with the curvature of the firing end 60 are exposed to an increased area for signal transmission over the round bottom detonator of the previous embodiment. Further, although the contact area is not the same for all signal transmission lines when the curved transmission surface is not uniform with the curvature of the firing end 60, the increased contact area serves to transmit a more reliable pressure impulse than conventional detonators of the prior art.

By providing an impulse transmission surface 75 on a round bottom detonator 40, an increased contact area for a plurality of signal transmission lines is provided and a substantially uniform pressure impulse may be transmitted thereto. Accordingly, this embodiment provides reliable initiation of a plurality of signal transmission lines proximate thereto in a detonator assembly. In addition, this increased contact area further serves to reduce the amount of explosive required by this embodiment of the present invention to generate a reliable pressure impulse of sufficient strength and duration to initiate a plurality of signal transmission lines, compared to detonators of the prior art. This reduction in the amount of explosive needed to reliably initiate a plurality of signal transmission lines further provides a reduction in noise and shrapnel within blasting systems. Again, this embodiment is provided to illustrate that alteration of the present invention to provide a transmission surface having an increased contact area for a plurality of transmission lines is not devoid of the present invention.

For the most part, the detonator devices of the present invention may be manufactured by conventional deep drawing technology.

Figure 8:
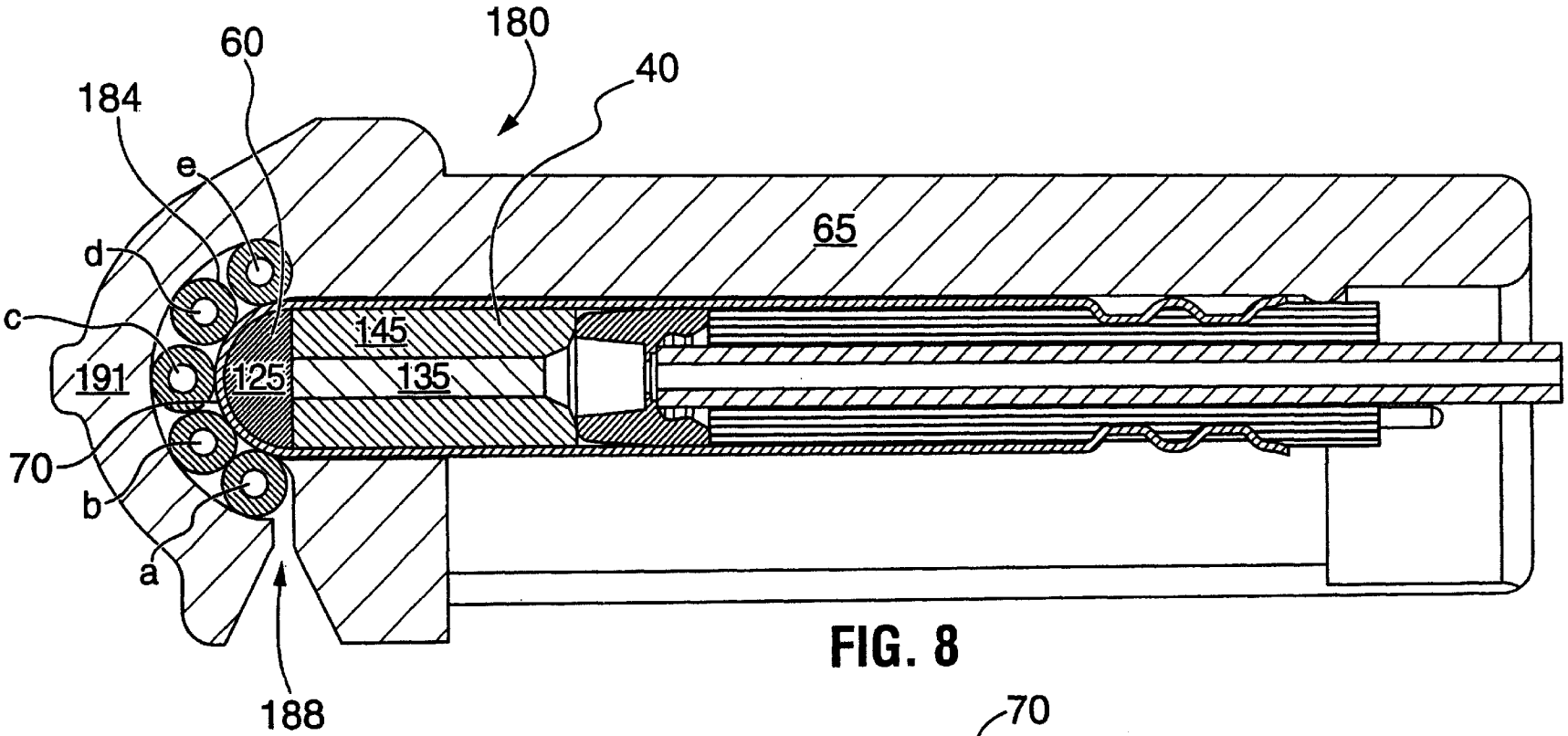
FIG. 8 is a cross section of the detonator assembly of the present invention.

As illustrated in FIG. 8, a detonator assembly 180 of the present invention includes a detonator 40 housed in a connector block 65 in impulse transmission contact with a plurality of signal transmission lines (a, b, c, d, e). Connector block 65 includes a conduit 182 with opposing open ends for receiving the body 50 of a detonator 40. A confining wall 191 extends from one of the opposing open ends to substantially define a transverse slot 184. Transverse slot 184 is adaptable to receive a plurality of signal transmission lines (a, b, c, d, e) therethrough. Transverse slot 184 includes an opening proximate one end of confining wall 191 which allows for the passage of the plurality of signal transmission lines into the slot 184. Connector 65 is preferably made from a durable plastic material. In particular, the connector 65 is preferably made from a suitable material for maintaining a plurality of signal transmission lines in substantially uniform confinement when subject to the impact of detonation.

Detonator 40 extends through conduit 182 such that firing end 60 projects into slot 184. In doing so, the shape of firing end 60 serves to further define the shape of slot 184 as it is received therein. Slot 184 is preferably shaped to conform with the shape of the outer surface of the contact wall or impulse transmission surface 70 of the detonator 40 of the present invention. In particular, connector 65 preferably includes a hemispherical transverse slot 184. Accordingly, the connector 65 is adaptable to receive the detonator 40 in uniform contact with a plurality of signal transmission lines (a, b, c, d, e) for the transmission of a pressure impulse from the detonator 40. Accordingly, a detonator assembly 180 of the present invention is provided to receive a plurality of signal transmission lines for the initiation by a uniform pressure impulse.

In a preferred embodiment of the present invention, a detonator assembly as illustrated in FIG. 8 is capable of simultaneously initiating a plurality of signal transmission lines with a uniform pressure impulse. According to a further embodiment of the present invention, connector block 65 is adaptable to receive a plurality of signal transmission lines with uniform confinement in a detonator assembly of the present invention.

Although the detonator of the present invention is preferably employed with a connector block 65 having a rounded slot 184 which is compatible with the shape of a convex outer surface of firing end 60, the detonator 40 of the present invention may also reliably initiate a plurality of signal transmission lines when employed with a conventional connector block, in a detonator assembly.

Figure 9:
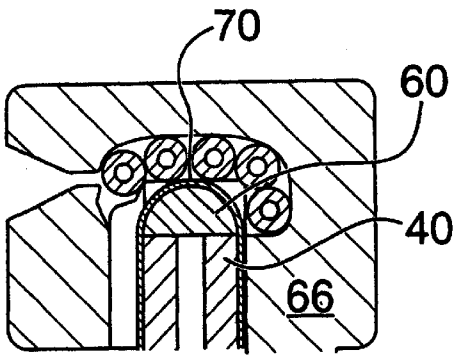
FIG. 9 is a sectional view of an embodiment of the present invention in connection with a conventional detonator connector block.

FIG. 9 illustrates a round bottom detonator 40 of the present invention positioned with respect to a plurality of signal transmission lines in a conventional connection block 66. As outlined in the Example below, the detonator device of the present invention displays improved initiation of a plurality of signal transmission lines over conventional detonators when employed with conventional connector blocks which do not accommodate a plurality of signal transmission lines in uniform contact with the detonator of the present invention or with preferred confinement. Although the plurality of signal transmission lines (a, b, c, d, e) are not uniformly positioned in impulse transmission contact with the transmission surface of firing end 60 in this case, the novel shape of firing end 60 nonetheless serves to concentrate the pressure impulse towards the signal transmission lines in order to achieve reliable initiation thereof. According to this arrangement, the signal transmission lines will not however receive a uniform pressure impulse.

In accordance with the further advantage of the present invention, the signal transmission lines of the embodiment of FIG. 9 will be reliably initiated with minimal production of residual noise and shrapnel. As illustrated by the following example, when the detonator of the present invention is employed with a conventional connector block 66 reliable initiation of at least six signal transmission lines can be achieved.

EXAMPLE

A comparative initiation test was conducted between round bottom detonators of the present invention and conventional flat end detonators. The detonators tested had an outside diameter of 7.5 mm and an inside diameter of 6.65 mm. The round bottom detonators had a closed hemispherical firing end having a diameter uniform with the inside diameter of the detonator body.

All test detonators were loaded with 200 mg of lead azide as the explosive material and pressed with a flat end punch at a force of 445 Newton. A lead delay element containing a pyrotechnic delay composition of silicon and red lead was inserted on top of the explosive composition and pressed at a force of 1180 Newton. Each test detonator further received an isolation cup, a rubber bushing and a two meter length of input shock tube and subsequently crimped into place.

The test detonators were each mounted into a conventional connector block proximate five output shock tubes. The opposite ends of these output shock tubes were closed by ultrasonic welding. These assemblies were subsequently wrapped in an insulating material and cooled to −60° C. in a refrigerator. The detonator assemblies were tested at −60° C. by firing the input shock tube of the connector block with a regular PETN based detonator. After firing, the two ends of the output shock tubes were examined for evidence of successful initiation, and the results were recorded, A total of 10 connector blocks were tested for each type of detonator configuration. The results of this comparative test are outlined below in Table 1.

A second initiation test was conducted according to the above protocol, with six shock tubes held in proximity to a round bottom detonator of the present invention by a conventional connector block. The results of this test revealed that all six shock tubes were reliably initiated by the round bottom detonator of the present invention in ten test models. These initiation results are outlined in Table 2 below.

A definitive improvement in the initiation rate of shock tubes was recorded by the round bottom detonators. Specifically, the round bottom detonators successfully initiated all shock tubes on firing, while the flat bottom detonators tested, recorded at least one initiation failure in each test.

This improvement was illustrated despite the employment of conventional connector blocks designed for use with flat bottom detonators. Consequently, a number of the shock tubes in this comparative test were not optimally positioned proximate the transmission surface of the round bottom detonator. Nevertheless, the reliability of the round bottom detonator of the present invention was evident.

The results of this comparative test suggest that use of the detonator device of the present invention with a compatible connector block 65, as illustrated in FIGS. 3 and 8, would achieve results at least as successful as the above tests when employed according to the protocol of the above Example. In particular, it is fully contemplated that the detonator assembly of the present invention would reliably initiate at least six signal transmission lines with a uniform pressure impulse.

When the detonators of the present invention are fitted with compatible connector blocks in a detonator assembly as herein disclosed, it is expected that the various embodiments of this invention would be more versatile compared with the results obtained when the detonator of the present invention is employed with conventional connector blocks, thereby providing reliable initiation of a plurality of shock tubes under a variety of working conditions.

In addition, the results of the above Example further support the alternative embodiments to the round bottom detonator discussed above.

TABLE 1

Summary of the number of failed shock tube initiation attempts when five shock tubes are employed in a connector block proximate a round bottomed detonator of the present invention.

| Detonator | Shock Tube Position | | | | |
|---|---|---|---|---|---|
| Type | 1 | 2 | 3 | 4 | 5 |
| flat bottom | 0 | 0 | 0 | 0 | 2 |
| round bottom | 0 | 0 | 0 | 0 | 0 |

TABLE 2

Summary of the number of failed shock tube initiation attempts when six shock tubes are employed in a connector block proximate a round bottomed detonator of the present invention.

| Detonator | Shock Tube Position | | | | | |
|---|---|---|---|---|---|---|
| Type | 1 | 2 | 3 | 4 | 5 | 6 |
| flat bottom | 0 | 1 | 0 | 0 | 0 | 0 |
| round bottom | 0 | 0 | 0 | 0 | 0 | 0 |

What we claim is:

1. A detonator for initiating a plurality of signal transmission lines with a pressure impulse, said detonator comprising: a signal receiving end, a firing end and an elongated body extending between said signal receiving end and said firing end, said firing end comprising a wall of substantially uniform thickness having a continuously curved convex outer impulse transmission surface for contacting all of a plurality of signal transmission lines, and a concave inner surface, said concave inner surface defining an inner region for holding an explosive composition;

an explosive composition confined within said inner region; and means for conveying a firing signal received at said signal receiving end to said explosive composition to initiate detonation of said explosive composition.

2. The detonator of claim 1, wherein said convex outer impulse transmission surface is shaped such that all of said plurality of transmission lines receive a uniform pressure impulse from said detonation at exactly the same time.

3. The detonator of claim 1, wherein said explosive composition has a distal surface facing said receiving end of said detonator, and said means for conveying said firing signal to said explosive composition causes said explosive composition to commence detonation at a central point on said distal surface.

4. The detonator of claim 3, wherein said distal surface is positioned, and said concave inner surface is shaped, such that a substantially equal amount of explosive composition, when evenly packed, is provided between said central point and each point on said concave inner surface.

5. The detonator of claim 4, wherein said distal surface is positioned at a location within said firing end such that a pressure impulse produced on detonation of said explosive composition impacts each point on said convex outer impulse transmission surface from a direction at an angle of 90+20° to a tangent at each said point of said convex outer impulse transmission surface.

6. The detonator of claim 1, wherein said convex outer impulse transmission surface is hemispherical.

7. The detonator of claim 1, wherein said convex outer impulse transmission surface is semi-cylindrical.

8. The detonator of claim 1, wherein said convex outer impulse transmission surface is shaped to make no more than point-contact with each of said plurality of transmission lines.

9. The detonator of claim 1, wherein said convex outer impulse transmission surface is shaped to make more than point-contact with each of said plurality of transmission lines.

10. The detonator of claim 9, wherein said convex outer impulse transmission surface is shaped to make an equal area of contact with each of said plurality of transmission lines.

11. The detonator of claim 1, wherein said explosive composition has a distal surface facing said signal receiving end of said detonator, and said distal surface has an outer edge that is chamfered outwardly in the direction of said signal receiving end of said casing.

12. The detonator of claim 11, wherein said means for conveying said firing signal includes an initiation element having a proximal surface in contact with said distal surface of said explosive composition.

13. The detonator of claim 12, wherein said proximal surface of the initiation element is chamfered to form an outer surface that contacts the entire outer edge of said distal surface of said explosive composition.

14. A detonator assembly for initiating a plurality of signal transmission lines with a pressure impulse, said detonator assembly comprising:

a detonator for initiating a plurality of signal transmission lines with a pressure impulse, said detonator comprising a signal receiving end, a firing end and an elongated body extending between said signal receiving end and said firing end, said firing end comprising a wall of substantially uniform thickness having a continuously curved convex outer impulse transmission surface for contacting all of a plurality of signal transmission lines, and a concave inner surface, said concave inner surface defining an inner region for holding an explosive composition; an explosive composition confined within said inner region, and means for conveying a firing signal received at said signal receiving to said explosive composition to initiate detonation of said explosive composition; and a connector element for receiving said detonator and all of said plurality of signal transmission lines in impulse transmission contact; said connector element comprising a conduit having opposing open ends for receiving said detonator; and a confining wall extending from one of said opposing ends to define a transverse slot for receiving all of said plurality of transmission lines therethrough; wherein when said detonator is positioned within said conduit, said convex outer impulse transmission surface extends into said transverse slot to contact all of said plurality of signal transmission lines.

15. The detonator assembly of claim 14 wherein said confining wall is shaped to define a substantially rounded transverse slot for receiving said plurality of signal transmission lines.

16. The detonator assembly of claim 15 wherein a distal surface of said transverse slot is further defined by the convex outer impulse transmission surface of said detonator.

17. The detonator assembly of claim 16 wherein said transverse slot is shaped to position said plurality of signal transmission lines in substantially uniform contact with the convex outer impulse transmission surface of said detonator.

18. The detonator assembly of claim 16 wherein said transverse slot is shaped to provide said plurality of signal transmission lines with substantially uniform confinement when positioned in contact with the convex outer impulse transmission surface.

19. The detonator assembly of claim 16 wherein said transverse slot is shaped to correspond with the length of said convex outer impulse transmission surface.

20. The detonator assembly of claim 16 wherein said transverse slot is a semi-circular slot.

21. A connector element for connecting a detonator having a continuously curved convex outer impulse transmission surface at a firing end of said detonator with all of a plurality of signal transmission lines, for transmission of a pressure impulse from said convex outer impulse transmission surface to all of said plurality of signal transmission lines; said connector element comprising:

a body portion;

a conduit extending through said body portion of said connector element; said conduit having opposing open ends; and a confining wall extending from one of said opposing ends and shaped to define a substantially rounded transverse slot having a curvature corresponding to said continuously curved convex outer impulse transmission surface of said firing end of said detonator; said transverse slot adapted to receive all of said plurality of signal transmission lines; and said conduit adapted to receive said detonator such that said convex outer impulse transmission surface of said firing end of said detonator extends into said transverse slot to contact all of said plurality of signal transmission lines; said conduit and said slot being mutually aligned such that, when said convex outer impulse transmission surface of said firing end of said detonator in said conduit is positioned in contact with all of said plurality of signal transmission lines within said transverse slot, each of said plurality of signal transmission lines is positioned to receive a uniform pressure impulse from said detonator.

22. The connector element of claim 21 wherein said transverse slot is shaped to provide said plurality of signal transmission lines with substantially uniform confinement when positioned in contact with the convex outer impulse transmission surface of said detonator.

23. The connector element of claim 21 wherein said transverse slot is shaped to correspond with the length of said convex outer impulse transmission surface such that all of said signal transmission lines are adaptable to be positioned in contact with said convex outer impulse transmission surface.

24. The connector element of claim 21 wherein said transverse slot is a semi-circular slot.

* * * * *

UNITED STATES PATENT AND TRADEMARK OFFICE

CERTIFICATE OF CORRECTION

PATENT NO. : 6,513,437 B2 
DATED : February 4, 2003
INVENTOR(S) : Chan, Sek K., Carriere, Raymond and Reid, John T.

It is certified that error appears in the above-identified patent and that said Letters Patent is hereby corrected as shown below:

Column 24,
Line 48, "90+20°" should read -- 90±20° --.

Signed and Sealed this

Eighth Day of July, 2003

JAMES E. ROGAN
*Director of the United States Patent and Trademark Office*